United States Patent [19]

Vogelpohl

[11] 4,084,113

[45] Apr. 11, 1978

[54] COLOR TELEVISION PICTURE TUBE STRUCTURE AND METHOD OF MANUFACTURE

[75] Inventor: Roland Louis Vogelpohl, Gahanna, Ohio

[73] Assignee: Owens-Illinois, Inc., Toledo, Ohio

[21] Appl. No.: 667,775

[22] Filed: Mar. 17, 1976

[51] Int. Cl.[2] ..... H01J 29/07; H01J 31/20

[52] U.S. Cl. ..... 313/408; 313/477 R; 313/482

[58] Field of Search ..... 313/402–408, 313/482

[56] References Cited

U.S. PATENT DOCUMENTS

| | | | |
|---|---|---|---|
| 3,971,490 | 7/1976 | Conger | 313/482 X |
| 3,997,811 | 12/1976 | Tom et al. | 313/482 X |

*Primary Examiner*—Robert Segal

*Attorney, Agent, or Firm*—Steve M. McLary; Edward J. Holler

[57] ABSTRACT

A rimless face panel is mounted on a funnel-shadow mask color selection device subassembly for a color television picture tube construction by indexing means establishing a unique positional relationship between the face panel and the mask. Bosses are formed on the inner walls of the funnel to receive mask support brackets which engage spring arms of brackets attached to the mask for precise spacing of the mask from the seal edge of the funnel. In a first embodiment, tabs are provided on the spring arms for engaging slots in the face panel to establish the positional relationship between the face panel and the mask during lighthousing and sealing. In a second embodiment, the tabs are formed on the mask support brackets. In a third and a fourth embodiments, studs in the face panel engage elongated apertures in the mask support brackets.

6 Claims, 20 Drawing Figures

COLOR TELEVISION PICTURE TUBE STRUCTURE AND METHOD OF MANUFACTURE

BACKGROUND OF THE INVENTION

1. Field of the Invention

This invention relates to color television picture tube structures and to methods of manufacturing such structures.

2. Description of the Prior Art

Color television picture tubes comprise a viewing face panel having a three color mosaic phosphor screen or image viewing portion of the face panel, a color selection device in the form of a shadow mask having an apertured pattern aligned with the phosphor areas of the selection colors and three electron guns for projecting separate electron beams through the mask at characteristic angles to activate the respective color phosphors on the screen. Color selection is achieved by selectively controlling the intensities of the electron beams. The spacing and alignment of the mask with respect to the gun and the mosaic phosphor screen must be established with precision and maintained throughout the fabrication and life of the tube. Slight rotational or longitudinal misalignment of the mask, screen and guns will result in degradation of the images developed and their color fidelity.

Heretofore, color picture tubes have been manufacuted in sections which are sealed together following necessary internal processing and subassembly. These sections include a viewing face panel comprising a screen portion of substantially spherical curvature and an integral rim portion or skirt extendinggenerally normal from the screen portion toward a funnel section and a neck of that funnel in which the electron gun assembly is mounted. Prior to assembly of the face panel and funnel, the mosaic phosphor screen is formed on the internal surface of the screen portion and the color mask is mounted by fastening it to the rim portion. The rim portion is then sealed to the funnel and the electron gun assembly is mounted in the neck of the funnel. The tube is then sealed, evacuated and gettered.

In order to obtain the degree of precision in alignment of the mask and screen assembly, the customary practice has been to form the screen by photographic processes by exposure of photo-sensitive resists including the several phosphors through the mask. The phosphors for the three colors are applied in sequence by applying a coating to the inner face of the viewing screen, precisely mounting the mask, exposing the screen to light through a mask from a point corresponding to the position in the final assembled tube of the electron gun for the subject color, fixing the pattern of phosphors for that color and removing the unfixed phosphor containing material from the inner face of the viewing screen. The photographic process is repeated for each color component of the phosphor screen, and therefore, the mask is removed and remounted a number of times during the screen forming process. It is essential that the mask be positioned with respect to the face panel in the same position for each photographic process and in the final assembly of the tube. Therefore, the mounting arrangement for the mask must be sufficiently rigid and precise to define a unique mask position with respect to the screen. Further, the relationship of the screen and mask subsequently as mounted on the funnel to the electron guns in the neck of the funnel must also be established as a unique position axially, longitudinally and in a planar to axial or tilt relationship.

The manufacturing steps and apparatus involved in the production of color picture tubes require precision in the manufacture of the screen assembly, funnel, seal edges between the screen assembly and funnel, and the funnel neck. Variations in the surface of the glass of the viewing screen can result in unacceptable distortion. Thus rejection losses are high even in the initial glass forming of the parts. The addition of mounting elements for the mask to the rim of the screen assembly is highly critical and subject to production losses. The separable screen assembly and mask must be jigged with precision relative to the lighthouse, the light source for photographically generating the phosphor mosaic, on each sequence for developing a pattern of phosphors for a color. The seal of the screen assembly and mounted mask to the funnel is subject to the misalignments either initally or is subject to distortion during the thermal cycling of the parts, both of which must be avoided or limited to a narrow range of dimensional tolerances.

There is shown in U.S. patent application Ser. No. 594,531, filed July 9, 1975 in the names of Elgin M. Tom and Roland L. Vogelpohl and assigned to the assignee of the present application, an improved face panel-shadow mask-funnel assembly. An array of cavities on the inner surface of the face panel interfit with the studs on the mask mounting brackets to provide transverse positioning while the bracket surfaces extending outward from the studs provide abutting surfaces to the inner face of the face panel adjacent its stud receiving cavities to establish face panel-shadow mask spacing. A glass funnel receives the mask in its devergent end with precise spacing of the mask from its seal edge. Portions of the mask mounting brackets are fitted into seats in the funnel which may be cavities or depressions in the seal edge to establish the spacing, particulary the depth of entry of the mask in the funnel. When the seated bracket portions also support the face panel indexing studs and are seated in the seal edge of the funnel, a precisely related, rugged construction results be sealing those bracket portions in the face panel-funnel seal. Transverse and circumferential indexing of the mask in the funnel is enhanced by providing integral indexing or reference surfaces on the inner walls of the funnel. Radially outward biasing means on a rigid mask frame are abutted against the funnel internal reference surfaces for transverse orientation of the mask and thus the face panel. Interfitting protuberances and cavities for the biasing means and reference surfaces, as slots in bosses on the funnel inner surface engaged by studs on the biasing means, provide circumferential orientation of the mask and thus the face panel on the funnel.

SUMMARY OF THE INVENTION

The present invention involves a color television picture tube construction employing a rimless viewing panel which is mounted on a funnel-shadow mask subassembly in precise spatial relationship therewith for final assembly. A glass funnel having those elements, where precise positioning is critical, referenced to surfaces from which the mask and thus the viewing panel are also referenced simplifies fabrication procedures and enhances precision in the assembled tube.

In one arrangement, a face panel of substantially spherical curvature and generally rectangular in its perimeter form is provided with at least two, and preferrably three, slots extended radially from the tube axis and spaced around the periphery on the inner face of the face panel adjacent its seal area. The slots are adapted to receive tabs on mask mounting brackets which are of a width which closely fit the width of the slots such that a unique mask position is established by fitting the tabs into the slots while the mask is secured to mask support brackets in the funnel with a spacing to register the tabs with the slots. Thus, the face panel is supported on the mask and its associated mounting brackets.

The funnel to be sealed to the face panel is provided with reference surfaces in the form of bosses for the mask supporting brackets. These bosses are referenced to the tube axis and are formed on the inner walls of the funnel adjacent the seal edge of the funnel to be mated with the face panel. The funnel bosses longitudinally, transversely and circumferentially orient the mask support brackets and thus the mask and the face panel with respect to the tube axis. Advantageously the face panel orientation places its seal area in contact with a seal edge on the funnel.

The funnel neck and funnel seal edge are also indexed with reference to the tube axis to enable the convenient mounting and alignment of the electron guns in the neck in their proper orientation with respect to the tube axis and thus the panel-mask assembly. In one embodiment, the funnel is formed into a subassembly by applying a tubular neck which ultimately is utilized as the electron gun assembly mounting in the finished tube. In one arrangement, the neck is applied with its inner surface referenced to the funnel axis and thereafter operations requiring critical index surfacing are referenced from the neck interior in the region in which the gun assembly is mounted thereby employing the coincident tube and gun as a reference. The seal edges of the funnel may then be ground normal to radii from the tube axis at the neck to conform generally to the spherical surface of the face panel margins. This axis also may be used to establish the mask support bracket seats, and in jigging the funnel during the mounting of the electron guns.

The rimless face panel offers a number of advantages in manufacture in that it can be formed from sheet glass by precision sagging or vacuum forming. Even if it is pressed, its inner surface can be lap ground to a true spherical contour thereby providing a more uniform spacing with the mask.

The sealing of the face panel to the funnel can be arranged to insure accurate final positioning of the face panel and mask by providing camming surfaces on the tabs which are advanced into the face panel slots to bring the face panel into alignment as the solder glass frit liquifies at the seal interface and the face panel settles onto the funnel seal edge.

In a second embodiment, the tabs are formed on the mask support brackets and have camming surfaces for engaging the slots in the face panel. In a third embodiment, the mask support brackets have elongated apertures formed therein for receiving tapered studs mounted in the inner surface of the face panel. In each of the first three embodiments, the mask support brackets are each seated on and solder glass sealed to a pair of bosses formed in the funnel. In a fourth embodiment, a single boss has a V-shaped notch formed therein for receiving a stud on the mask support bracket which is then solder glass sealed to the boss.

In accordance with the above, an object of this invention is to improve the structure of color television picture tubes.

Another object is to improve the optical quality of the viewing screen of color television picture tubes.

A third object is to increase the precision of alignment of the phosphor mosaic, mask and electron guns for color television picture tubes.

Another object of the invention is to provide a method of sealing the face panel to the funnel which will effect a substantial heat savings.

A further object is to simplify the manufacture of color television picture tubes.

The above and additional objects and features of this invention will be appreciated more fully from the following detailed description of preferred embodiments when read with reference to the accompanying drawings.

DESCRIPTION OF THE PREFERRED EMBODIMENTS

Figure 1:
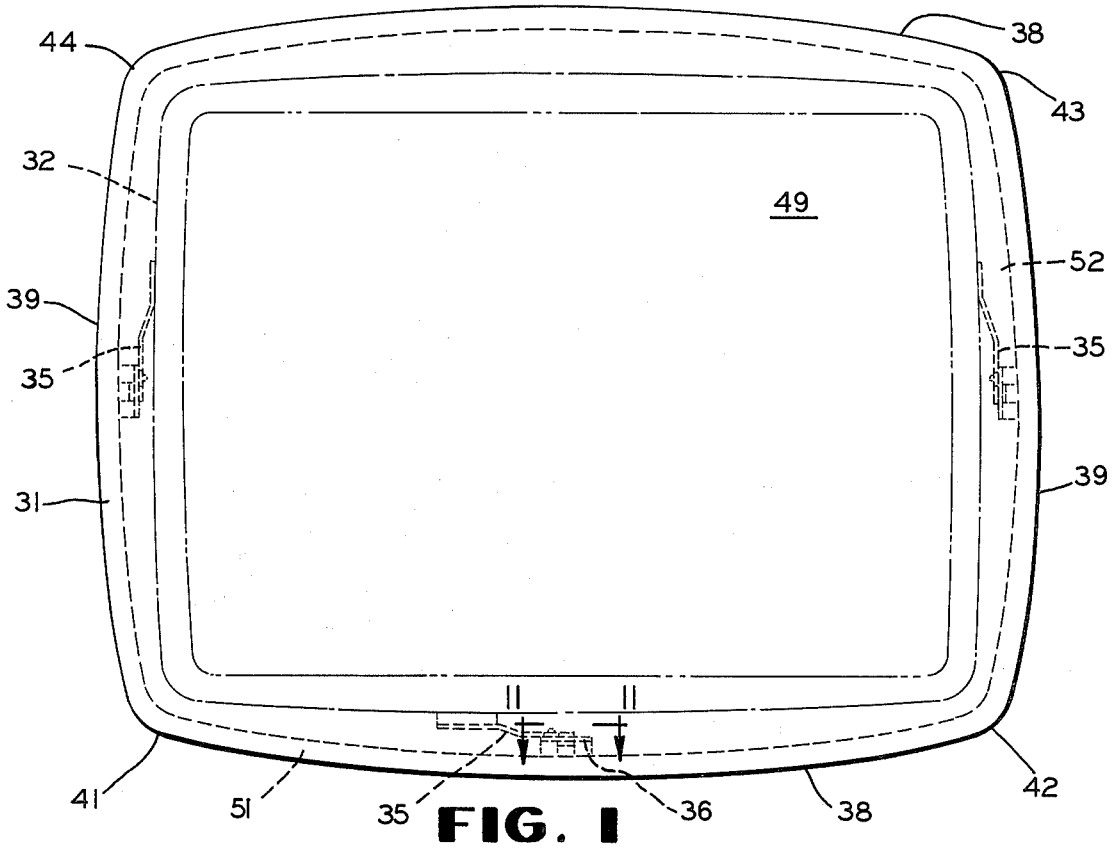
FIG. 1 is a front view of a rectangular color television picture tube according to this invention.

FIGS. 1 through 4 show a color television picture tube assembly according to one embodiment of the present invention. A face panel 31 is mounted on a shadow mask 32 by means of brackets 33 having indexing means for engaging the face panel 31 and a funnel 34 to precisely orient the panel, the mask and the funnel with respect to one another. Circumferential and transverse orientation of the face panel 31 and the mask 32 are referenced to the funnel 34 by means of at least two and generally three mask brackets 33 as shown. Each of the brackets 33 has an outwardly biased spring arm 35 which engages a mask support bracket 36 mounted on a pair of bosses 37 formed on the interior wall of the funnel 34.

Figure 3:
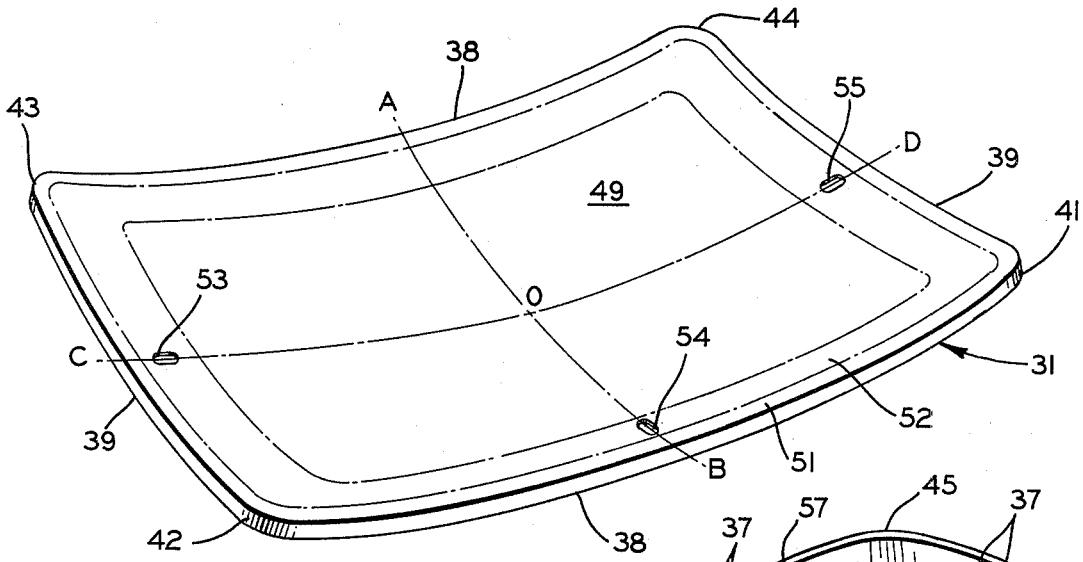
FIG. 3 is a perspective view of the interior of a face panel according to this invention.
Figure 4:
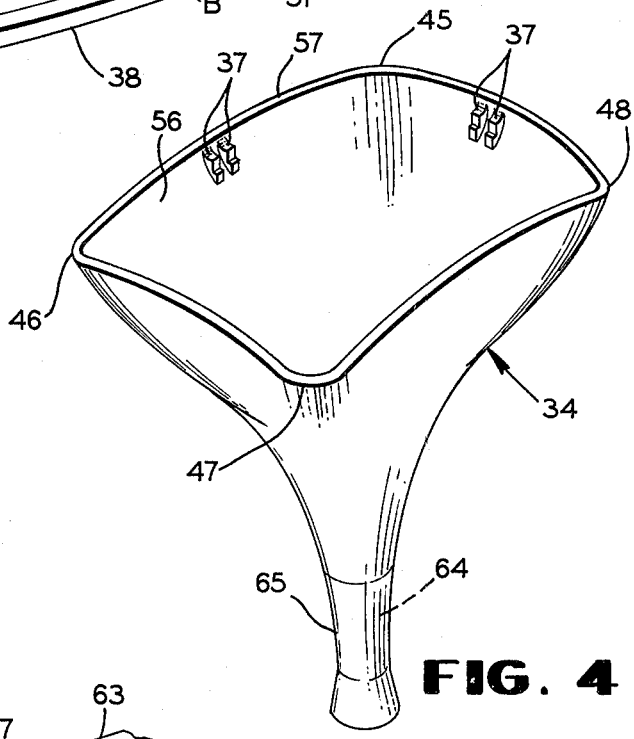
FIG. 4 is a perspective view of a funnel-neck subassembly according to this invention.

The face panel 31, as shown in FIG. 3, has a spherical surface and is of retangular form having long sides 38 and short sides 39 with rounded corners 41, 42, 43 and 44 to mate with corners 45, 46, 47 and 48 respectively of the funnel 34. The rimless nature of the face panel 31 enables it to be made of a glass blank of essentially uniform thickness with an image viewing region 49 over an internal area and a perimeter region including an area 51 to be sealed to the funnel 34 and an area 52 shaded from the electron gun beams by the mask mounting structure. Mask-face panel indexing elements on the face panel can be in the perimeter region 52 without interfering with the image viewing region 49.

Color and image fidelity in a color television picture tube are dependent upon the surface characteristics of the tube face panel. Ideally, a true spherical surface should be provided. Practically, such surfaces have been unobtainable in commercial quantities at acceptable cost. Pressed face panels tend to have a wavy surface and tend to have dimples distributed over the surface to produce an effect termed "golf balling" for the resemblance to the surface of a golf ball. The present face panel has no rim upstanding from its concave spherical surface in its perimeter region 51. Accordingly, a truer spherical surface can be achieved as by precision sagging of sheet or plate glass panels or by pressing spherical surface panels and lap grinding the interior of those pressed panels to a spherical form. In each such process, the wavy and golf ball surfaces are avoided.

In prior art constructions, the positional relationship between the face panel and the shadow mask has been established by mounting the mask on the rim of the face panel. In the assembly of the present invention, the face panel is mounted on the funnel-mask subassembly. Such mounting is adapted for the repetitive assembly and disassembly of a mask and panel during the forming of the multicolor phosphor mosaic with precision equal to or exceeding that of the past construction. At least two and advantageously three indexing positions coupling the face panel 31 to the shadow mask 32 are provided. They are arranged to accommodate the slight dimensional variations of the elements while maintaining a fixed relationship between the elements relative to the tube axis by providing interfitting indexing elements which have a range of relative motion both along a respective radius and a respective arc from the point of intersection of the tube axis.

Three slots 53, 54, and 55 are formed in the inner face of the face panel 31 in the shaded area 52 of the perimeter region and afford one element of an indexing means for the panel. Cooperating with those slots in a first embodiment are tabs or pins formed on the distal ends of the spring arms 35 which are the complementary elements of the indexing means. In the drawings, the radial and arcuate latitude of the positions of the interfitting and complementary indexing means are shown provided along centerlines of the face panel as the lines A-O-B and C-O-D of FIG. 3 where O is the nominal center of the panel at the intersection of the tube and ultimate electron gun axis with the panel inner face when assembled in the tube. However, it is to be appreciated that a unique positional relationship can be established where the element affording positional latitude radially is on the bracket and the fixed element is on the face panel or where the indexing means on both elements offer a degree of postional latitude as will be discussed with respect to the other embodiments of the present invention. Also the longitudinal axis of the slots need not be coextensive with its associated panel centerline but may be coextensive with radii from the center O at other positions along the sides 38 and/or 39 or at two or more of the corners 41 through 44.

Figure 2:
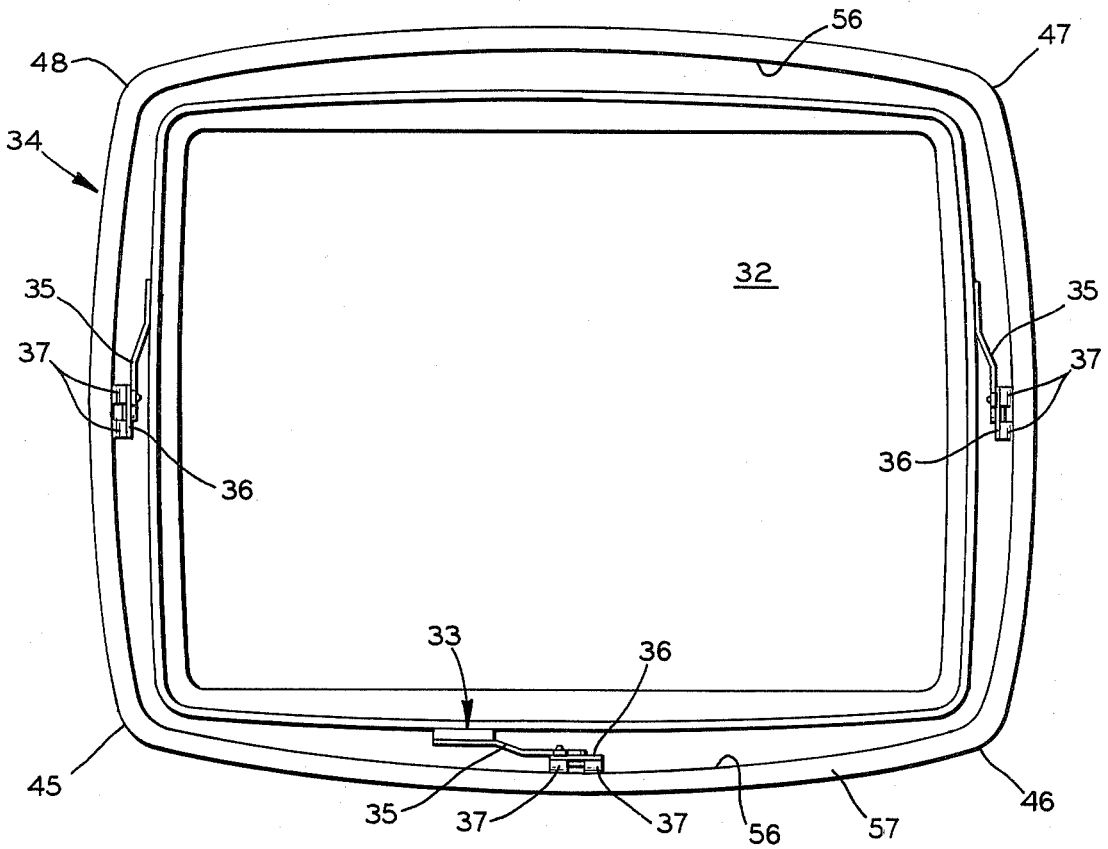
FIG. 2 is a view as in FIG. 1 with the face panel removed to illustrate the indexing and mounting of a mask frame and the face panel.
Figure 5:
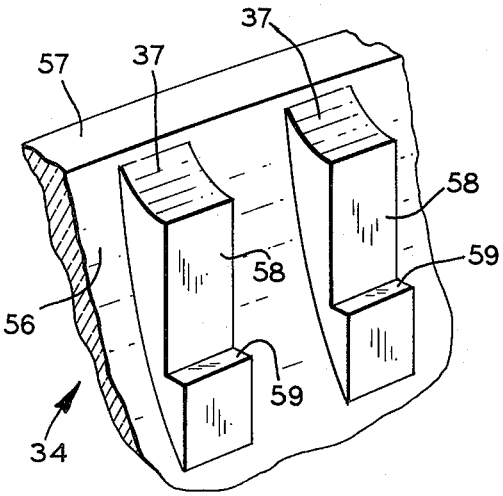
FIG. 5 is an enlarged fragmentary perspective view of a wall of a funnel and a pair of bracket support bosses formed therein.

Referring now to FIGS. 4 through 8, there is shown in more detail one of the indexing means of FIG. 2. Each pair of the bosses 37 is formed on the interior surface of the funnel 34. In FIG. 5, the bosses 37 are formed on a long wall 56 of the funnel 34 adjacent a seal edge 57. Mounting surfaces for the bracket 36 can then be ground with great precision from reference positions. For example, a pair of surfaces 58 lying in a plane substantially parallel to and referenced from the longitudinal axis of the funnel 34 and a pair of surfaces 59 lying in planes substantially perpendicular to the longitudinal axis of the funnel and referenced from the gun assembly mounting position are shown. Each pair of bosses is also precisely located along the circumference of the funnel to position the shadow mask and the face panel.

Figure 7:
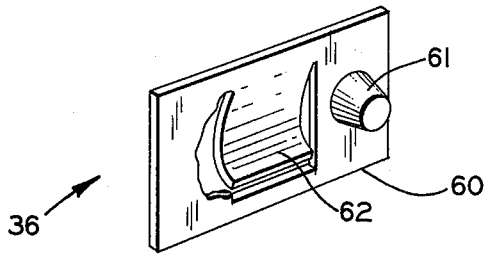
FIG. 7 is an enlarged fragmentary perspective view of the mask support bracket shown in FIG. 6.

There is shown in FIG. 7 the mask support bracket 36 having a tapered stud 61 upstanding from a rectangular planar surface and positoned adjacent one of the shorter sides. A central tab 62 is punched out of the center of the bracket 36 and bent to provide a guide which cooperates with the groove between the bosses to align the bracket on the ground surfaces and position the stud 61. Generally the width of the groove can be controlled during the molding process so that the central tab engages the walls of the groove. However, the groove walls can be ground for increased precision. The stud 61 is positioned with respect to the central tab 62 and a lower edge 60 of the bracket 36. The lower edge 60 is seated on the mounting surfaces 59 to define the position of the stud 61 along the longitudinal axis of the funnel, a rear planar surface of the bracket 36 is seated on the mounting surfaces 58 to define the radial distance of the stud from the longitudinal axis and the tab 62 is seated in the groove to define the circumferential position of the stud. The bracket 36 is then solder glass sealed to the bosses 37.

Figure 6:
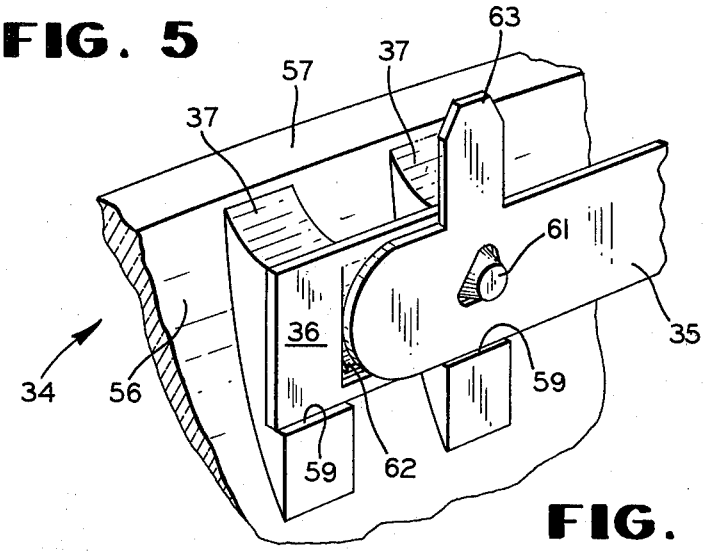
FIG. 6 is an enlarged fragmentary perspective view of a funnel and the elements which facilitate transverse and circumferential positioning of the shadow mask within the funnel as well as longitudinal position and surface orientation along the tube axis for the face panel, shadow mask and funnel according to a first embodiment.
Figure 8:
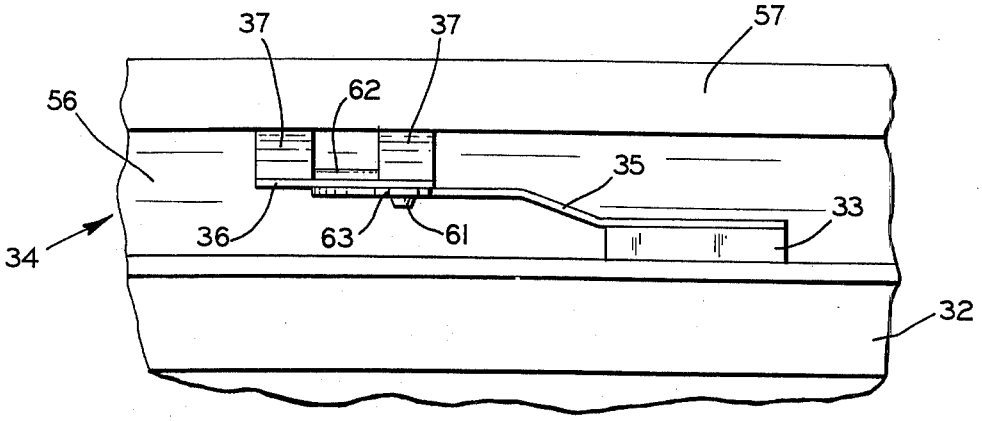
FIG. 8 is an enlarged fragmentary plan view of the funnel and elements of FIG. 6.

As shown in FIGS. 6 and 8, the spring arm 35 has an aperture formed in the distal end thereof for receiving the stud 61. The aperture may be essentially triangular-shaped for a three point contact with the tapered stud. The shadow mask 32 and the funnel 34 are easily assembled by biasing the spring arms inwardly toward the mask as the mask is lowered into the funnel and then releasing the spring arms when the apertures are aligned with the studs. Now the shadow mask is held securely in the funnel and is accurately positioned with respect to its axial and circumferential orientation. As shown in FIG. 2, the bosses on the opposite short sides of the funnel are aligned so that the radial biasing forces of the spring arms are balanced. The third pair of bosses is triangularly related to the opposed pairs of bosses to provide a stable mounting base for the shadow mask.

Referring again to FIG. 6, it will be seen that the distal end of the biased spring arm 35 has a generally upstanding tab 63 formed thereon having a longitudinal axis parallel to the longitudinal axis of the funnel 34. The tabs cooperated with the slots 53, 54 and 55 of the face panel 31 of FIG. 3 as the complementary elements of the indexing means. While the radial latitude of the relative positions of the tabs 63 in their respective slots is provided by forming the length of the slots to loosely fit the tabs, the positions are closely constrained transverse of the radius to define the desired unique relative position of the face panel to the mask. This is accomplished by forming the width of the slots to closely fit the width of the tabs when the tabs are fully seated in the slots. For example, with tabs 63 centered on radii from the nominal center of the mask, which is also coincident with the longitudinal axis of the funnel 34 and a gun assembly mounting position 64 in a neck 65 of the funnel 34, the indexing is realized if the slots are formed with portions of their widths adapted to register with the tabs having the widths thereof centered on radii from the nominal center of the shadow mask. Face panel-shadow mask self alignment is realized by employing a tapered edge camming surface either side of the tab slot engaging end as shown in FIG. 6. Slight misalignments of the face panel 31 relative to the shadow mask 32 are corrected as one or the other camming surface is carried across the edge of the corresponding slot during advancement of the face panel toward the bracket 36 and spring arm 35. This camming action is significant in the repetitive mounting of the panel on masks for forming the multicolor phosphor mosaic and in the final assembly where a bead of solder glass frit for sealing is laid between the seal area 51 of the face panel and the seal edge 57 of the funnel.

Figure 9:
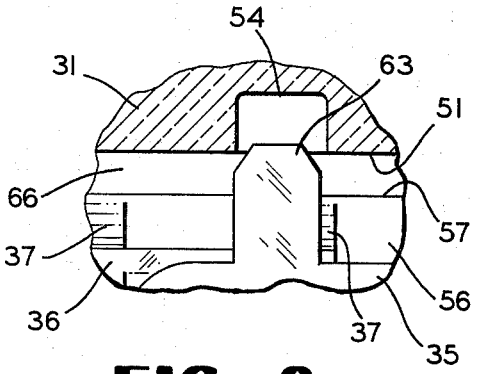
FIGS. 9 through 11 are enlarged fragmentary section views taken along the line 11—11 of FIG. 1 to show the progressive seating and alignment of the face panel on the shadow mask biased spring arm tabs as the glass frit seal is formed and the panel settles against the fluid seal material.
Figure 10:
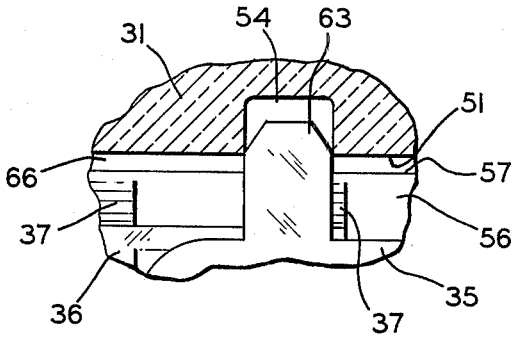
Figure 11:
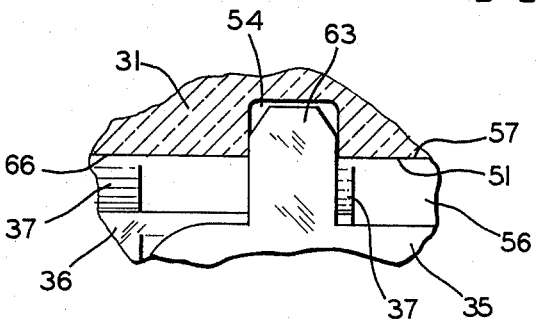

FIGS. 9, 10 and 11 show the progressive seating and alignment of the face panel on the shadow mask during the sealing of the face panel to the funnel. A frit bead 66 as initially laid down spaces the face panel 31 from the funnel 34. During the heating of the elements to effect the seal, force, typically gravity where the face panel is uppermost, tends to bring the face panel seal area 51 against the funnel seal edge 57 as the frit softens and in effecting a bond, flows over the edges and from between them. The face panel 31 settles toward the funnel 34 and the tab 63 cams the face panel into alignment as it rides over the edge of the slot 54 until in the seated position the edges of the tab are tightly embraced by the end walls of the slot and the seal area and the seal edge are separated by a thin layer of solidified frit.

It is desirable to form the various glass indexing elements during the formation of the face panel and the funnel. However, in some instances those indexing elements may not be formed with sufficient precision. Accordiningly, they may be machined either in their entirety or as a final trimming for greater precision. If the face panel is plate or sheet glass trimmed to size and sagged to the spherical contour, the mask referencing slots can be machined with diamond end mills or with ultrasonic grinding equipment. In pressed face panels, the slots can be formed during pressing and, if necessary, finally machined to the precise width and length centered on the radius from the face panel center and the tube axis 0.

In order that all of the critical reference surfaces are related to the tube axis, the funnel 34 is chucked for application of the neck 65 centered on the axis with minimum tilt by conventional techniques. Thereafter, machining of the funnel-neck subassembly can be referenced to the interior of the neck as defining the ultimate electron gun assembly axis and the coincident tube axis. The funnel seal edge 57 can be spherically ground employing the tube axis at the gun assembly mounting position 64 as the reference center thereby conforming to the face panel seal area 51 since the spherical contour of the face panel is based on a similar center and radius. The bosses 37 can be ground employing the gun assembly mounting position 64 as the reference center. Since the electron gun assembly is installed with reference to the neck 65 and thus the same references with which the funnel-neck subassembly was positioned to grind the bosses, the projection of the gun centerline has minimum eccentricity in relation to the face panel and shadow mask.

Figure 12:
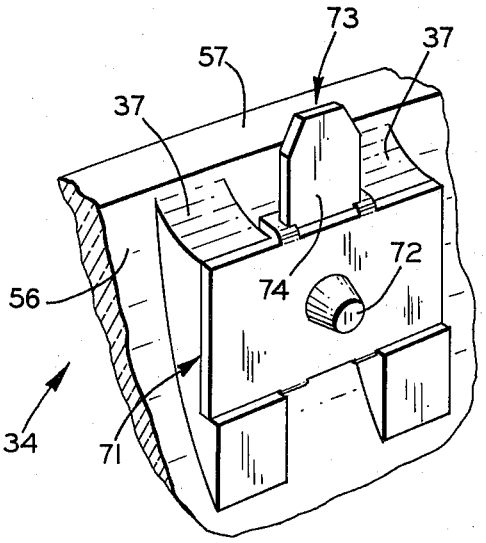
FIG. 12 is an enlarged fragmentary perspective view of a funnel and a mask support bracket according to a second embodiment of the present invention.
Figure 13:
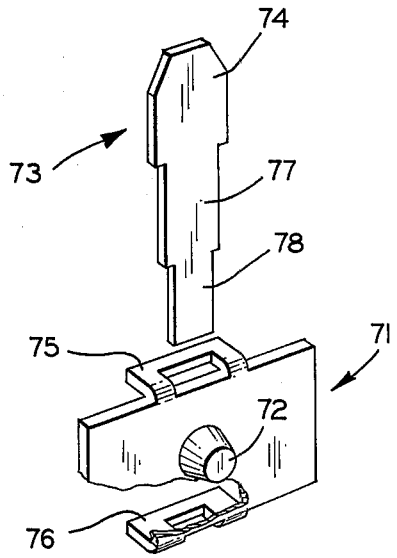
FIG. 13 is an enlarged fragmentary perspective view of the support bracket shown in FIG. 12.

The positioning of the face panel with respect to the shadow mask by supporting it from the funnel-mask subassembly lends to variations of indexing means, as shown in FIGS. 12 and 13. FIG. 12, which is similar to FIG. 6, shows a pair of bosses 37 formed on the long wall 56 of the funnel 34 adjacent the seal edge 57. The bosses are ground for receiving a mask support bracket 71 according to a second embodiment of the present invention. The bracket 71 is affixed to the bosses 37 with solder glass. A centrally located tapered stud 72 is upstandingly positioned on a rectangular planar surface of the bracket. The stud 72 cooperates with an aperture in the distal end of a biased spring arm attached to the shadow mask in the same manner as the stud 61 and the biased spring arm 35 of FIG. 4. A generally upstanding tab or pin 73 has an upper portion 74 which cooperates with the slot 54 of the face panel 31 shown in FIG. 3. The tab upper portion 74 has a tapered edge camming surface at either side thereof for realizing face panel-shadow mask self alignment. The tab 73 is retained in a pair of slots formed in the bracket 71. An upper tab retainer 75 and a lower tab retainer 76 are formed in the same plane as the body of the bracket 71 and then are bent 90° to extend in a direction opposite to that of the stud 72. The tab retainers provide a guide which cooperates with the groove between the bosses to align the bracket on the ground surfaces and position the stud 72. Each of the tab retainers has a rectangular aperture formed therein, both apertures having the same width, but with the upper aperture being longer than the lower aperture. The tab 73 has a center portion 77 which is narrower than the upper portion 74 and a lower portion 78 which is narrower than the center portion 77. The upper and lower slot widths closely fit the center and lower portions respectively to provide a stable base for the tab 74. The length of the center portion 77 is slightly less than the distance between the upper surfaces of the two tab retainers so that the tab 73 is supported on the upper tab retainer by the shoulders formed at the junction of the upper portion 74 and the center portion 77.

Figure 14:
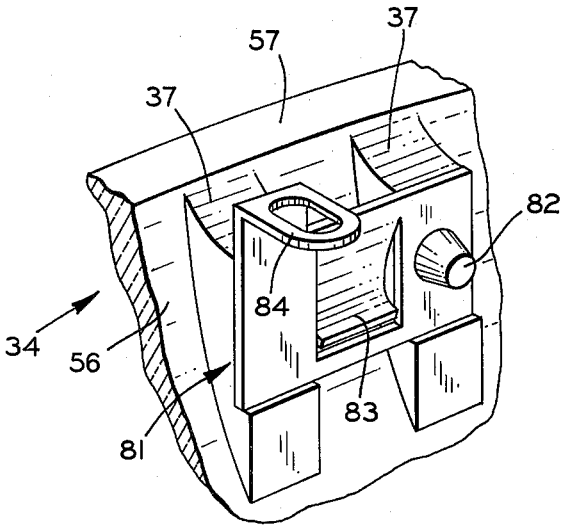
FIG. 14 is an enlarged fragmentary perspective view of a funnel and mask support bracket according to a third embodiment of the present invention.
Figure 15:
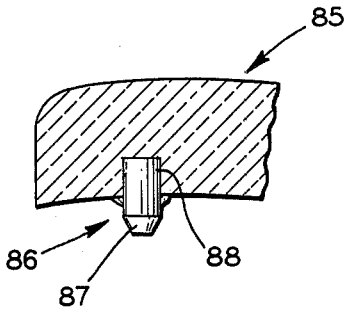
FIG. 15 is an enlarged fragmentary sectioned elevational view of a face panel according to the third embodiment.

There is shown in FIGS. 14 and 15, a third embodiment of the present invention. FIG. 14, which is similar to FIGS. 6 and 12, shows a pair of bosses 37 formed on the long wall 56 of the funnel 34 adjacent the seal edge 57. The bosses are ground for receiving a mask support bracket 81 according to a third embodiment of the present invention. The bracket 81 is affixed to the bosses 37 with solder glass. A tapered stud 82 is upstanding positioned on a rectangular planer surface of the bracket toward one end thereof. A central tab 83 is punched out of the center of the bracket 81 and is bent to provide a guide which cooperates with the groove between the bosses to align the bracket on the ground surfaces and position the stud 82. The stud cooperates with an aperture in the distal end of a biased spring arm attached to the shadow mask in the same manner as the stud 61 and the biased spring arm 35 of FIG. 5.

A stud retainer 84 is formed along the upper edge of the bracket 81 in the same plane as the main body of the bracket. Then the stud retainer is bent at a 90° angle to the plane of the main body. The stud retainer has an elongated aperture formed therein with a longitudinal axis aligned with a radius from the longitudinal axis of the funnel-mask subassembly. In FIG. 15 there is shown a a face panel 85 having a stud 86 mounted therein and sealed thereto with a fairing of glass. This stud replaces the slot 54 in the face plate 31 of FIG. 3 and the slots 53 and 55 would also be replaced by studs in the third embodment. The stud 86 has a lead taper 87 for camming the face panel to its final position as the stud enters the aperture in the stud retainer 84 of the bracket 81. The width of the elongated aperture closely fits the diameter of a base portion 88 of the stud 86 and the length of the stud is sufficient to permit the lead taper 87 of each stud to be inside its respective stud retainer aperture when the solder glass bead of the seal between the face panel 85 and the funnel 34 is thick, as at the initial assembly of the two parts. As the solder begins to flow in the sealing cycle, the panel will settle toward the seal edge 57 and the base portion 88 of the stud will enter and be closely confined by the aperture wall to again seek the unique centering and rotational relationship it originally had with the mask during lighthousing.

Figure 16:
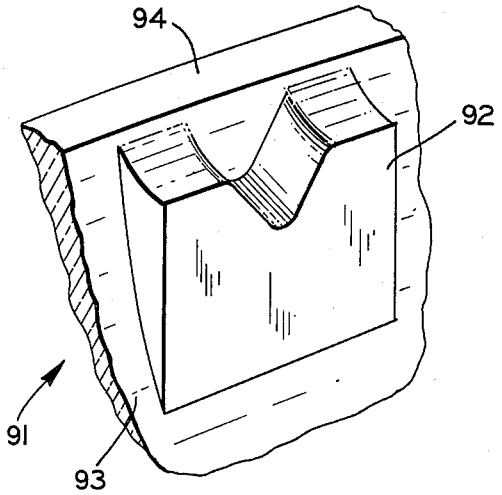
FIG. 16 is an enlarged fragmentary perspective view of a wall of a funnel and a bracket support boss formed therein.
Figure 17:
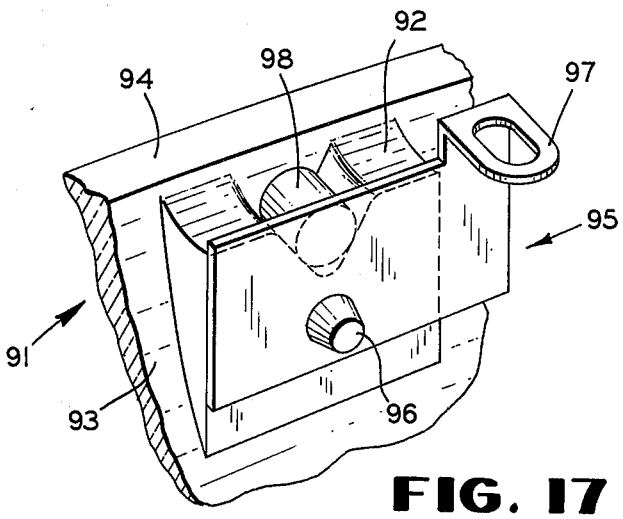
FIG. 17 is an enlarged fragmentary perspective view of the funnel of FIG. 16 and a mask support bracket according to a fourth embodiment of the present invention.

In FIG. 16, there is shown a portion of a picture tube funnel 91 having a single boss 92 formed on an inside wall 93 thereof adjacent a seal edge 94. The upper surface of the boss 92 has a generally V-shaped notch formed therein having a longitudinal axis along a radius extending from the longitudinal axis of the funnel-mask subassembly. The seal edge 94 is ground with reference to the notch. If required, the inwardly facing surface of the boss 92 can be ground with great precision for mounting a mask support bracket 95 as shown in FIG. 17.

The bracket 95 includes an upstanding tapered stud 96 positioned toward one end of the generally rectangular face of the bracket. There is also a stud retainer 97, similar to the stud retainer 84 of FIG. 14, formed at the other end of the bracket along the upper edge thereof. The stud retainer includes an elongated aperture for receiving a stud in a face panel similar to the stud 86 in the face panel 85 of FIG. 15. The bracket 95 also has a stud 98 formed on its outwardly facing surface for engaging the notch in the boss 92. A solder glass seal is then effected between the boss and the bracket to securely hold the bracket in place. The stud retainer aperture, the tapered stud 96 and the stud 98 are precisely located with respect to one another to maintain the relationship between the face panel and mask developed during lighthousing.

Figure 18:
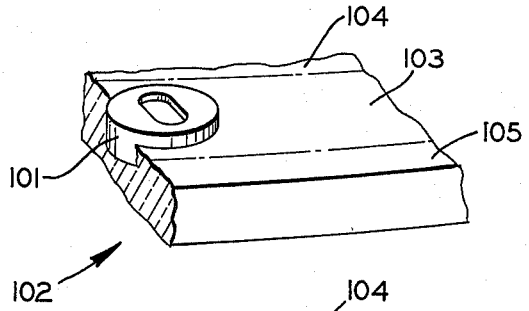
FIGS. 18 through 20 are enlarged fragmentary perspetive views of a face panel showning alternate forms of tab engaging means.
Figure 19:
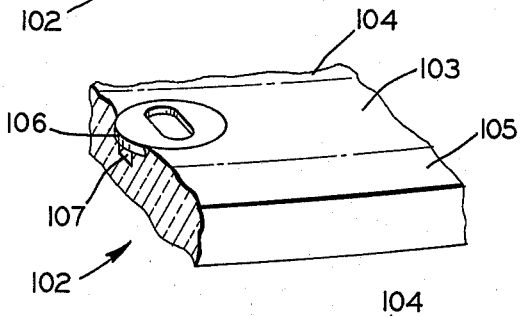
Figure 20:
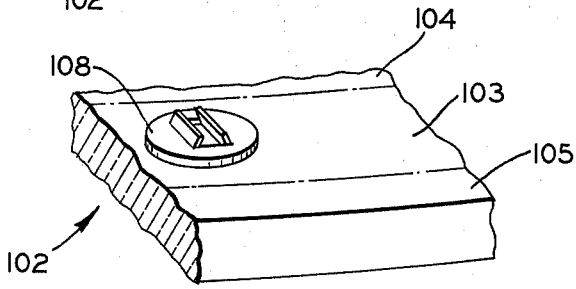

There is shown in FIGS. 18 through 20 three alternate tab receiving means which are similar to those disclosed in the previously referenced patent application Ser. No. 594,531 and may be utilized in place of the slots shown in FIG. 3. In FIG. 18, a cup 101 formed of metal has its open end embedded in the inner surface of a face panel 102 in a shaded area 103 between an image viewing region 104 and a seal area 105. The bottom of the cup has an elongated aperture formed therein for receiving a tab according to the first and second embodiments of the present invention. In FIG. 19, a flat metal washer 106 is mounted flush with the inner surface of the face panel 102. The washer 106 has an elongated aperture formed therein for receiving a tab and the face panel has a cavity 107 formed beneath the washer for receiving the end of the tab. There is shown in FIG. 20 a third alternate tab receiving means. A metal disk 108 is mounted on the inner surface of the face panel 102 and has a pair of upstanding ears having parallel edges to define an elongated aperture for receiving a tab.

During lighthousing, the face panel and shadow mask are jigged with a light source to simulate the final tube assembly utilizing a separate jig for each phosphor color. Formation of the phosphor mosaic on the image viewing area 49 of the face panel 31 is accomplished with greater convienience than heretofore since the face panel is merely placed on the upstanding tabs 63 of the spring arms 35 in the first embodiment and upstanding tabs corresponding to the tabs 74 of the mask support bracket in the second embodiment or the panel studs 86 are placed into the elongated apertures of brackets similar to the mask support brackets 81 and 95 of the third and fourth embodiments. In the first two embodiments, the tapered edges of the tabs guide the face panel into its unique positional relationship with the mask as they are advanced into the slots in the face panel. In the third and fourth embodiments, the lead taper on the studs in the face panel guide the face panel into its unique positional relationship with the mask as they are advanced into the elongated apertures in the mask supporting brackets. During lighthousing a separate jig is utilized for each color so that the repetitive mounting and dismounting of the face panel on the shadow mask is required during the repetitive cycles of phosphor application, photographic exposure, and removal of excess phosphors. The triangular relationship of the indexing means and the camming action between elements thereof preserves the unique positional relationship between the face panel and the shadow mask.

Assembly of the shadow mask 32 and the funnel 34 with the proper orientation establishes the position of the face panel 31 on the funnel 34. The axial position of the spherically contoured mask, the transverse orientation of the mask to establish its nominal center on the longitudinal axis of the tube and the circumferential orientation of the mask around the tube axis are all established by the precision of the location of the mask support brackets on the associated funnel bosses and the precision of the location of the brackets 33 with the spring arms 35 with respect to the mask. Thus, only one mounting of the shadow mask 32 within the surrounding walls of the funnel 34 is required in the fabrication of the tube to establish its orientation in all three directions by abutments against glass reference surfaces which can be formed or ground.

Since the system of engagement of three tabs in the funnel-mask subassembly into matching slots in the inside surface of the face panel assures that any mask will repeatedly assume one unique position relative to any given face panel, the relationships employed in lighthousing for mosaic formation can be repeated in the funnel-mask subassembly during the sealing of the face panel to the funnel. Thus, the inside surface of the face panel and the shadow mask contour have the same spacing or "Q" distance as established during lighthousing since it is established by abutting surfaces which can be precisely located. This virtually eliminates the adverse effects of variations in tube axial lengths.

The face panel to funnel positioning and seal is accomplished by having a bead 66 of solder glass frit on either the seal area 51 of the face panel or the seal edge 57 of the funnel with the face panel and mask indexing means in at least near registry and engaged. The taper on the tabs in the first and second embodiments or the lead taper on the studs of the third and fourth embodiments will cam into the slots or elongated apertures respectively as the frit bead flows during the seal heating cycle. When the face panel is uppermost so that gravity biases it to seat on the brackets and the aligned seal edge of the funnel, it seeks its formerly established unique positonal relationship with the shadow mask as the solder glass frit softens and flows to permit the settling of the face panel toward funnel assembly with this process. Since the metal jigs used in the prior art method of sealing absorbed approximately one half of the heat used and are now eliminated, the present invention represents a substantial energy savings.

It is to be appreciated that the structure and method of fabrication of color television picture tube face panel-shadow mask-funnel assemblies by mounting the face panel and shadow mask on the brackets attached to the inside walls of the funnel lends itself to structures other than those illustrated. For example, the face panel contour and outline and conforming mask contour and outline might be other than spherical and rectangular respectively. Alternative reference positions for establishing indexing surfaces in the funnel might be established in place of the interior of the funnel neck at the electron gun assembly position. The form of the mask support brackets and the mask brackets 33 including the spring arms 35 can be altered without the loss of the functions of precise positioning within the funnel and mounting and positioning the face panel on the funnel. For example, the tapered studs could be formed on the spring arms and the cooperating apertures could be formed in the mask support brackets.

In accordance with the provisions of the patent statutes, the principle and mode of operation of the invention have been explained and illustrated in its preferred embodiments. However, it must be understood that the invention may be practiced otherwise than as specifically illustrated and described without departing from its spirit or scope.

What is claimed is:

1. A color television picture tube comprising:

a rimless face panel of generally spherical surface contour and generally rectangular outline including a first element of an indexing means for establishing a unique positional relationship between said face panel and a shadow mask;

a glass funnel having a divergent wall terminating at its divergent end in a seal edge for mating with said face panel which is of generally rectangular outline and is scalloped to a spherical contour matching said face panel contour and having a plurality of bosses formed on the insides of said divergent walls adjacent said seal edge, said bosses being formed in pairs to define a groove therebetween;

at least a pair of shadow mask support brackets attached to separate opposed bosses of said plurality of bosses, said brackets each having a mask mounting means formed thereon, said mask support brackets further including upper and lower tab retainers formed thereon for engaging the walls of said groove to position said mask support brackets as they are attached to said bosses; and a generally rectangular shadow mask color selection device fitting within said funnel adjacent said seal edge and having brackets extending from the sides of said shadow mask, said brackets adopted to engage said mounting means of said mask support brackets, said mask brackets and said mask support brackets forming a second element of said indexing means.

2. A color television picture tube according to claim 1 wherein said indexing means first element is a flat washer mounted flush with the inner surface of said face panel and having an elongated aperture formed therein in registry with and receiving said indexing means second element.

3. A color television picture tube according to claim 2 wherein said face panel has a cavity formed beneath said flat washer.

4. A color television picture tube according to claim 1 wherein said indexing means first element is a disk mounted on the inner surface of said face panel having a pair of upstanding ears with parallel edges to define an elongated aperture in registry with and receiving said indexing means second element.

5. A color television picture tube according to claim 1 wherein said upper and lower tab retainers each have an aperture formed therein and said mask support bracket includes a tab having a lower portion for engaging said lower tab retainer aperture and a center portion for engaging said upper tab retainer aperture.

6. A color television picture tube comprising:

a rimless face panel of generally spherical surface contour and generally rectangular outline including an inner surface having an image viewing region surrounded by a shaded area surrounded by a seal area and at least three elongated slots formed in said shaded area, each of said elongated slots positioned along a different side of said face panel; a glass funnel having a divergent wall terminating at its divergent end in a seal edge for mating with said face panel seal area which is of generally rectangular outline and is scalloped to a spherical contour matching said face panel contour and having at least three pairs of bosses formed on the inside of said divergent wall adjacent said seal edge, each of said pair of bosses forming a groove between said bosses;

at least three shadow mask support brackets, one attached to each pair of said bosses, said mask support bracket having a mask mounting means formed thereon having upper and lower tab retainers formed thereon for engaging the walls of said groove to position said mask support bracket as it is solder glass sealed to said bosses and said upper and lower tab retainers each having an aperture formed therein, and having a generally upstanding tab formed thereon for engaging said elongated slots, said tab having a lower portion for engaging said lower tab retainer aperture, a center portion for engaging said upper tab retainer aperture and an upper portion having tapered edges for camming said tab over the edges of said elongated slots; and a generally rectangular shadow mask color selection device fitting within said funnel adjacent said seal edge and having brackets with spring arms extending from the sides thereof, the distal ends of spring arms adapted to engage said mask mounting means.

* * * * *